US008635880B2

(12) United States Patent
Jeong et al.

(10) Patent No.: US 8,635,880 B2
(45) Date of Patent: Jan. 28, 2014

(54) REFRIGERATOR HAVING A PLURALITY OF STORAGE CONTAINERS AND CONTROL METHOD OF THE SAME

(75) Inventors: Ha Jin Jeong, Gwangju (KR); Hak Gyun Bae, Andong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 513 days.

(21) Appl. No.: 12/805,916

(22) Filed: Aug. 24, 2010

(65) Prior Publication Data

US 2011/0094726 A1 Apr. 28, 2011

(30) Foreign Application Priority Data

Oct. 26, 2009 (KR) ..... 10-2009-101908

(51) Int. Cl.
*F25B 41/00* (2006.01)

(52) U.S. Cl.
USPC ..... 62/203; 62/441; 62/442

(58) Field of Classification Search
USPC ..... 62/203, 441, 442
See application file for complete search history.

(56) References Cited

U.S. PATENT DOCUMENTS

| | | | | |
|---|---|---|---|---|
| 6,786,056 | B2 * | 9/2004 | Bash et al. | 62/199 |
| 7,913,515 | B2 * | 3/2011 | Nuiding | 62/525 |
| 2006/0179858 | A1 * | 8/2006 | Yoshioka et al. | 62/203 |
| 2007/0084238 | A1 * | 4/2007 | Son et al. | 62/527 |
| 2007/0271954 | A1 * | 11/2007 | Bauer et al. | 62/441 |

FOREIGN PATENT DOCUMENTS

| | | |
|---|---|---|
| KR | 10-2005-0119463 | 12/2005 |
| KR | 10-2006-0114964 | 11/2006 |

* cited by examiner

*Primary Examiner* — Cheryl J Tyler
*Assistant Examiner* — Jonathan Bradford
(74) *Attorney, Agent, or Firm* — Staas & Halsey LLP

(57) ABSTRACT

A refrigerator having a valve to control the supply of a refrigerant to a plurality of storage chambers and a control method of the same. An opening time rate of the valve is changed based on modes of the storage chambers to control the amount of the refrigerant supplied to the storage chambers, thereby avoiding concentration of the refrigerant in one of the storage chambers and thus preventing refrigerant shortage in the other storage chambers. Also, left and right temperature deviation of each storage chamber is reduced, thereby achieving uniform temperature distribution of each storage chamber.

15 Claims, 10 Drawing Sheets

FIG. 7

| FIRST STORAGE CHAMBER | SECOND STORAGE CHAMBER | THIRD STORAGE CHAMBER | T1 | T2 | T3 | P1 | P2 | P3 |
|---|---|---|---|---|---|---|---|---|
| KIMCHI CHAMBER | KIMCHI CHAMBER | KIMCHI CHAMBER | 40s | 30s | 30s | 40% | 30% | 30% |
| FREEZING CHAMBER | KIMCHI CHAMBER | KIMCHI CHAMBER | 30s | 60s | 60s | 20% | 40% | 40% |
| FREEZING CHAMBER | KIMCHI CHAMBER | OFF | 30s | 90s | 0 | 25% | 75% | 0 |

T1:OPENING TIME OF FIRST OUTLET PORT
T2:OPENING TIME OF SECOND OUTLET PORT
T3:OPENING TIME OF THIRD OUTLET PORT
P1:OPENING TIME RATE OF FIRST OUTLET PORT
P2:OPENING TIME RATE OF SECOND OUTLET PORT
P3:OPENING TIME RATE OF THIRD OUTLET PORT

REFRIGERATOR HAVING A PLURALITY OF STORAGE CONTAINERS AND CONTROL METHOD OF THE SAME

CROSS-REFERENCE TO RELATED APPLICATIONS

This application claims the benefit of Korean Patent Application No. 2009-0101908, filed on Oct. 26, 2009 in the Korean Intellectual Property Office, the disclosure of which is incorporated herein by reference.

BACKGROUND

1. Field

Embodiments relate to a refrigerator having a valve to control the supply of a refrigerant to a plurality of storage chambers and a control method of the same.

2. Description of the Related Art

Generally, a refrigerator is operated such that a refrigerant is compressed into a high-temperature and high-pressure gas refrigerant by a compressor, the high-temperature and high-pressure gas refrigerant is condensed into a room-temperature and high-pressure liquid refrigerant by a condenser, and the room-temperature and high-pressure liquid refrigerant is supplied to an evaporator, disposed around a storage chamber, where the refrigerant is evaporated to cool the storage chamber, thereby storing foods at predetermined temperature.

In a structure in which a plurality of storage chambers are provided in a refrigerator, a refrigerant valve mounted on refrigerant channels disposed between a condenser and evaporators of the storage chambers is operated to control the amount of the refrigerant distributed to the respective evaporators, thereby satisfying temperature conditions of the storage chambers.

During simultaneous operation of the storage chambers, the operation of the refrigerant valve is controlled to distribute the refrigerant to the evaporators of the storage chambers while changing the refrigerant channels every predetermined time.

In a conventional refrigerator, however, an opening time rate of the refrigerant valve is fixed with respect to the respective storage chambers. For example, on the assumption that three storage chambers are used as Kimchi chambers, the opening time rate of the refrigerant valve is fixed for each of the storage chambers such that the first storage chamber has an opening time rate of 40%, the second storage chamber has an opening time rate of 30%, and the third storage chamber has an opening time rate of 30%. On the assumption that opening time of the refrigerant valve to supply the refrigerant to the evaporator of the first storage chamber is 40 seconds, therefore, opening time of the refrigerant valve to supply the refrigerant to the evaporator of the second storage chamber is set to 30 seconds, and opening time of the refrigerant valve to supply the refrigerant to the evaporator of the third storage chamber is set to 30 seconds.

In recent years, temperature of a storage chamber may be set according to user's liking. That is, the storage chamber may be used as a freezing chamber while the storage chamber is used as a Kimchi chamber.

In the conventional refrigerator, however, the refrigerant valve is opened at the fixed opening time rate even when the Kimchi chamber is changed to the freezing chamber.

Consequently, lower pressure is generated in the freezing chamber than in the Kimchi chamber, with the result that load in the freezing chamber is relatively low, and therefore, the refrigerant is concentrically supplied to the evaporator of the freezing chamber. That is, refrigerant concentration occurs. Generally, temperature of the Kimchi chamber is controlled to −1° C.; however, temperature of the freezing chamber is controlled to −18° C.

When the Kimchi chamber is cooled by a direct cooling system to directly cool the storage chamber using a pipe-type evaporator disposed to surround the outer perimeter of the storage chamber, left and right temperature deviation of the storage chamber is further increased due to refrigerant shortage.

SUMMARY

It is an aspect to provide a refrigerator wherein an opening time rate of a valve to supply a refrigerant to evaporators is changed based on modes of storage chambers to prevent refrigerant shortage due to concentration of the refrigerant, thereby achieving uniform temperature distribution of each storage chamber and a control method of the same.

Additional aspects will be set forth in part in the description which follows and, in part, will be apparent from the description, or may be learned by practice of the invention.

In accordance with one aspect, a refrigerator includes a plurality of storage chambers, a valve having a plurality of outlet ports to supply a refrigerant to the storage chambers, and a controller to control the valve such that only one of the outlet ports is opened when the refrigerant is supplied to the storage chambers, wherein the controller controls opening time of the valve based on modes of the storage chambers to which the refrigerant is supplied.

The controller may control a rate of the refrigerant to be distributed into the respective storage chambers according to the modes of the storage chambers. Specifically, the controller may control the amount of the refrigerant to be supplied to the storage chambers based on a time rate corresponding to predetermined temperatures of the storage chambers.

The controller may control at least two of the outlet ports to be alternately opened and closed to supply the refrigerant to at least two of the storage chambers such that the refrigerant is alternately supplied to the storage chambers.

The controller may control the at least two of the outlet ports to be opened based on the time rate corresponding to the predetermined temperatures of the storage chambers to which the refrigerant is supplied when controlling the at least two of the outlet ports to be alternately opened and closed.

The time rate corresponding to the predetermined temperatures of the storage chambers may be preset such that an opening time rate of the outlet ports corresponding to the storage chambers is low when predetermined temperatures of the storage chambers are low.

In accordance with another aspect, a control method of a refrigerator including a plurality of storage chambers and a valve having a plurality of outlet ports to supply a refrigerant to the storage chambers includes controlling the valve such that only one of the outlet ports is opened when the refrigerant is supplied to the storage chambers, wherein controlling the valve comprises determining modes of the storage chambers to which the refrigerant is supplied and controlling opening time of the valve based on the determined mode of the storage chambers.

The control method may further include controlling a rate of the refrigerant to be distributed into the respective storage chambers according to the modes of the storage chambers, wherein controlling the rate of the refrigerant may include controlling an amount of the refrigerant to be supplied to the storage chambers based on a time rate corresponding to predetermined temperatures of the storage chambers.

The control method may further include controlling at least two of the outlet ports to be alternately opened and closed to supply the refrigerant to at least two of the storage chambers such that the refrigerant is alternately supplied to the storage chambers.

Controlling the at least two of the outlet ports to be alternately opened and closed may include controlling the at least two of the outlet ports to be opened based on the time rate corresponding to the predetermined temperatures of the storage chambers to which the refrigerant is supplied.

The time rate corresponding to the predetermined temperatures of the storage chambers may be preset such that an opening time rate of the outlet ports corresponding to the storage chambers is low when predetermined temperatures of the storage chambers are low.

BRIEF DESCRIPTION OF THE DRAWINGS

These and/or other aspects will become apparent and more readily appreciated from the following description of the embodiments, taken in conjunction with the accompanying drawings of which:

FIG. 7 is a view illustrating opening time and opening time rate of the refrigerant valve according to modes of storage chambers in the refrigerator according to the embodiment;

DETAILED DESCRIPTION

Figure 1:
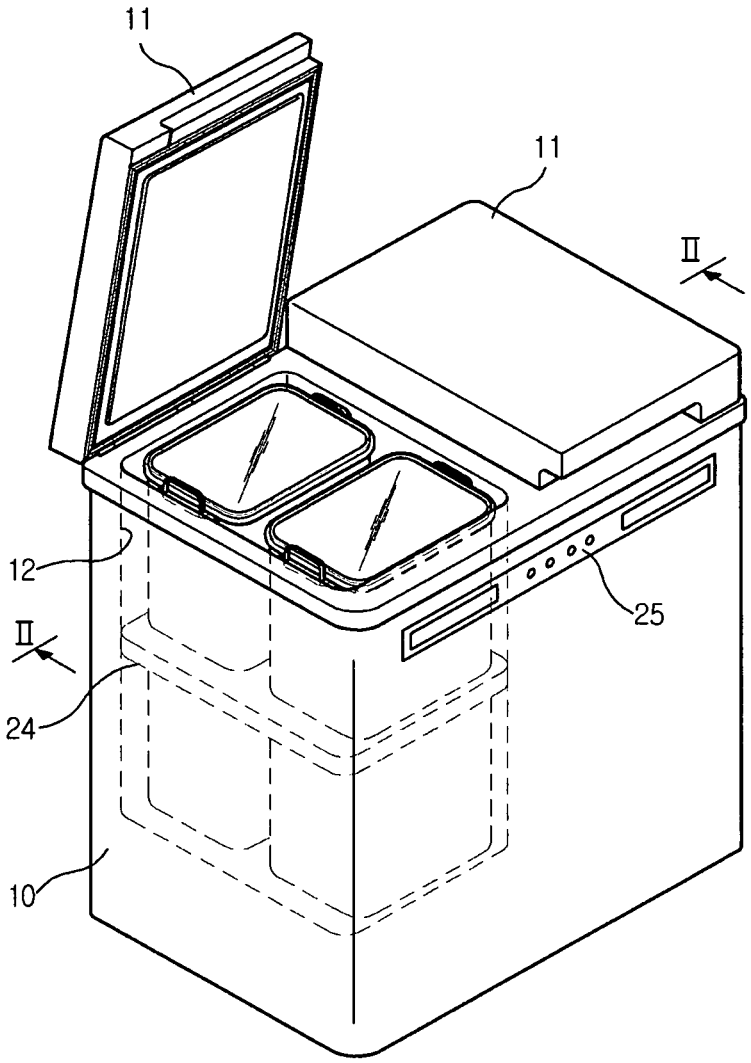
FIG. 1 is a perspective view illustrating a refrigerator according to an embodiment.

Reference will now be made in detail to the embodiments, examples of which are illustrated in the accompanying drawings, wherein like reference numerals refer to like elements throughout.

Figure 2:
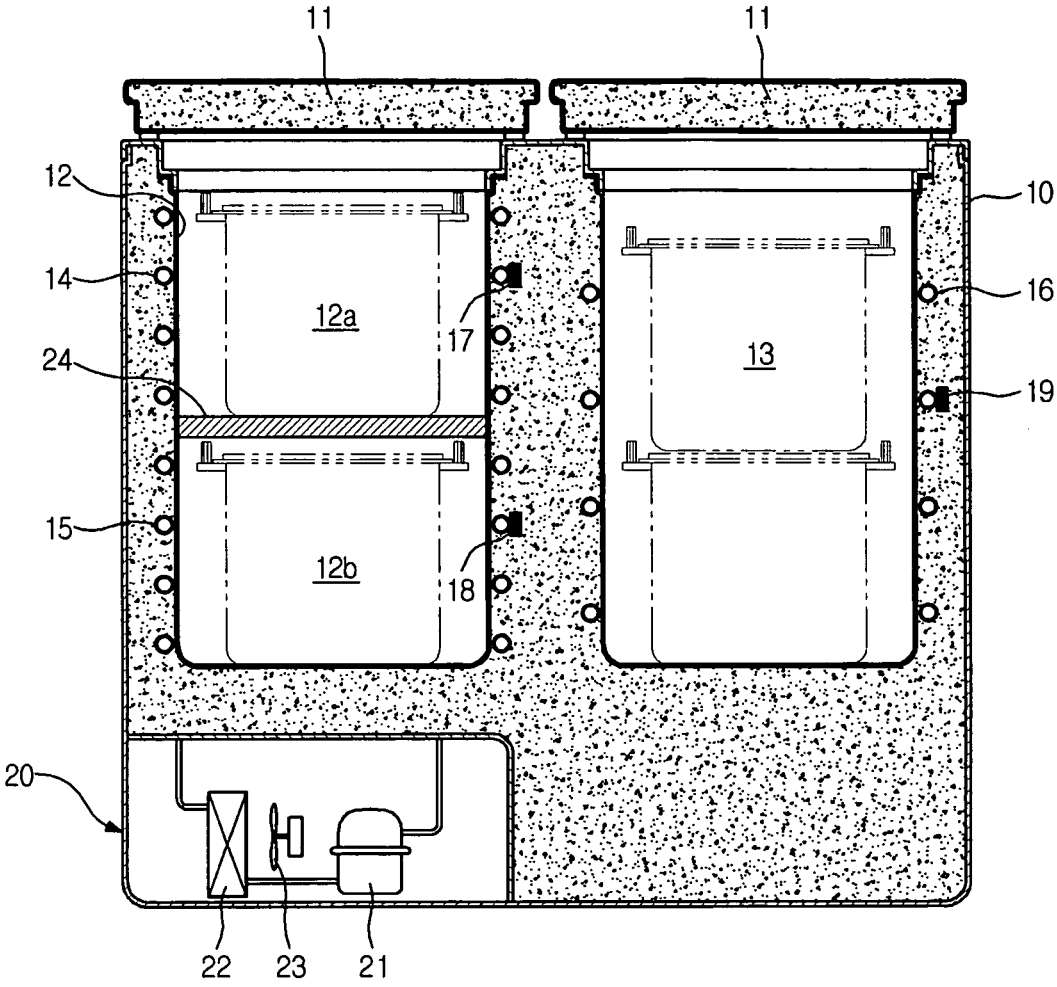
FIG. 2 is a sectional view illustrating the internal structure of the refrigerator of FIG. 1.

FIG. 1 is a perspective view illustrating a direct cooling type refrigerator according to an embodiment, and FIG. 2 is a sectional view taken along line II-II of FIG. 1.

As shown in FIGS. 1 and 2, the refrigerator includes left and right storage chambers 12 and 13 defined in a main body 10, doors 11 hingedly coupled to the top of the main body 10 to open and close the left and right storage chambers 12 and 13, and an input unit 25 provided at the upper front of the main body 10.

Below the left and right storage chambers 12 and 13 is provided an electric equipment chamber 20 in which cooling devices are located. The electric equipment chamber 20 is separated from the left and right storage chambers 12 and 13 by a partition wall. Spaces defined between the left and right storage chambers 12 and 13 and the outside are filled with a heat insulation material to uniformly maintain temperatures of the left and right storage chambers 12 and 13.

Around the upper outer perimeter of the left storage chamber 12 are mounted a first evaporator 14 to perform heat exchange and a first temperature sensor 17 to detect surface temperature of the first evaporator 14 to sense temperature of the upper part of the left storage chamber 12. Around the lower outer perimeter of the left storage chamber 12 are mounted a second evaporator 15 to perform heat exchange and a second temperature sensor 18 to detect surface temperature of the second evaporator 15 to sense temperature of the lower part of the left storage chamber 12.

In the left storage chamber 12 is mounted a partition 24 to divide the upper and lower parts of the left storage chamber 12. The partition 24 prevents exchange of cool air between the upper and lower parts of the left storage chamber 12 such that temperatures are independently controlled in the upper and lower parts of the left storage chamber 12. The upper and lower parts of the left storage chamber 122 divided by the partition 14 will hereinafter be referred to as first and second storage chambers 12*a* and 12*b*.

Around the outer perimeter of the right storage chamber 13 are mounted a third evaporator 16 to perform heat exchange and a third temperature sensor 19 to detect surface temperature of the third evaporator 16 to sense temperature of the right storage chamber 13. The right storage chamber 13 will hereinafter be referred to as a third storage chamber 13.

In this embodiment, two evaporators are mounted at the left storage chamber, and one evaporator is mounted at the right storage chamber for the convenience of description. Alternatively, one evaporator may be mounted at the left storage chamber, and two evaporators may be mounted at the right storage chamber. Besides, two or more evaporators may be mounted at both the storage chambers. In the electric equipment chamber are disposed a compressor 21 to compress a refrigerant, a condenser 22 to condense the refrigerant compressed by the compressor 21, and a blowing fan 23 mounted at one side of the condenser 22 to forcibly blow air to the condenser 22.

Figure 3:
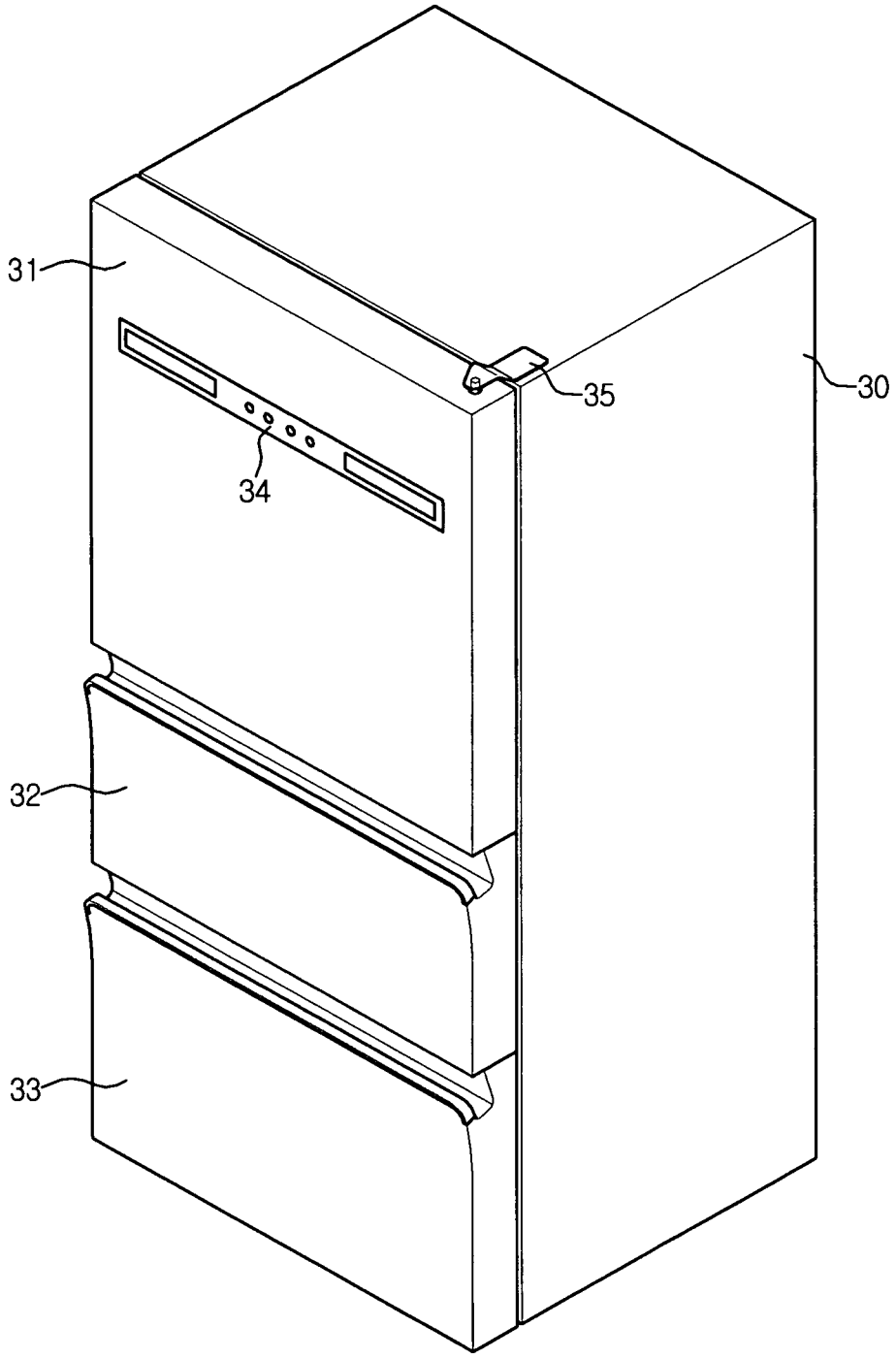
FIG. 3 is a perspective view illustrating a refrigerator according to another embodiment.
Figure 4:
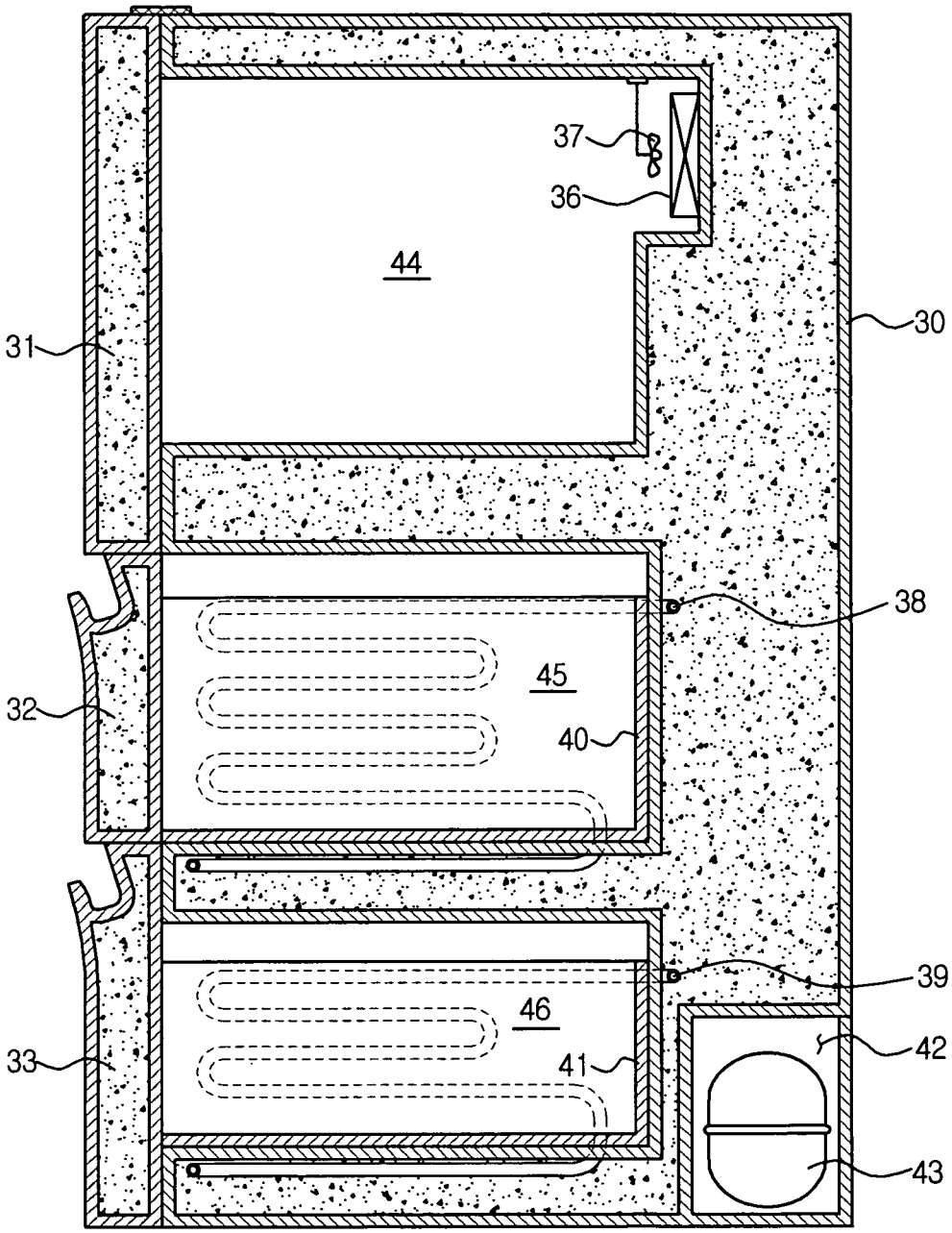
FIG. 4 is a sectional view illustrating the internal structure of the refrigerator of FIG. 3.

FIG. 3 is a perspective view illustrating a direct and indirect type combination kimchi refrigerator including one indirect type storage chamber disposed in the upper part of the refrigerator and two direct type storage chambers disposed in the lower part of the refrigerator, and FIG. 4 is a sectional view illustrating the internal structure of the direct and indirect type combination kimchi refrigerator shown in FIG. 3.

As shown in FIGS. 3 and 4, an indirect type storage chamber 44 is defined in the upper part of the direct and indirect type combination kimchi refrigerator. A door 31 is coupled to a main body 30 via a hinge 35 to open and close the front opening of the indirect type storage chamber 44. At the front of the door 31 is provided an input unit 34 to allow a user to input operating conditions of storage chambers 44, 45 and 46.

At one side of the indirect type storage chamber 44 are provided an evaporator 36 including a pipe and a cooling fin and a blowing fan 37 to supply cool air from the evaporator 36 to the indirect type storage chamber 44. Internal air is heat-exchanged with the low-temperature evaporator 36 into cool air, which is forcibly supplied to the indirect type storage chamber 44.

In the indirect type storage chamber 44, the evaporator 36, which is a cool air supply source, is located at one side of the storage chamber, unlike the direct type storage chambers 45 and 46, with the result that temperature deviation in the storage chamber is high, and moisture evaporation of food in the storage chamber is high due to forcible movement of air by the blowing fan 37. Since the evaporator 36 does not directly contact the inside of the storage chamber, however, frost generation is low, and wide-range temperature control is achieved according to control of the blowing fan 37.

The direct type storage chambers 45 and 46, disposed below the indirect type storage chamber 44, include drawer type containers 40 and 41 and doors 32 and 33 coupled to the containers 40 and 41 to open and close the front openings of the containers 40 and 41.

At the outer perimeters of the direct type storage chambers 45 and 46 are disposed pipe type evaporators 38 and 39, which are buried in a heat insulation material between the main body 30 and the outer perimeters of the storage chambers, such that the evaporators 38 and 39 surround the outer perimeters of the direct type storage chambers 45 and 46. Cool air transmitted from the low-temperature evaporator 38 to the outsides and insides of the storage chambers through heat conduction is supplied to the direct type storage chambers 45 and 46 through natural convection of air in the storage chambers.

In the direct type storage chambers 45 and 46, the evaporators 38 and 39, which are cool air supply sources, directly contact the outsides of the storage chambers, with the result that frost is formed at the insides of the storage chambers. Since the evaporators 38 and 39 surround the outer perimeters of the storage chambers, however, the cool air supply sources are uniformly distributed as compared with the indirect type storage chamber 44, with the result that temperature deviation in the storage chambers is low. Also, the blowing fan 37 is not provided, with the result that evaporation of moisture from food in the storage chamber is low.

At the tops of the storages chambers 44, 45 and 46 are mounted temperature sensors (not shown) to detect temperatures of the evaporators 37, 38 and 39 to sense temperatures of the storage chambers.

Figure 5:
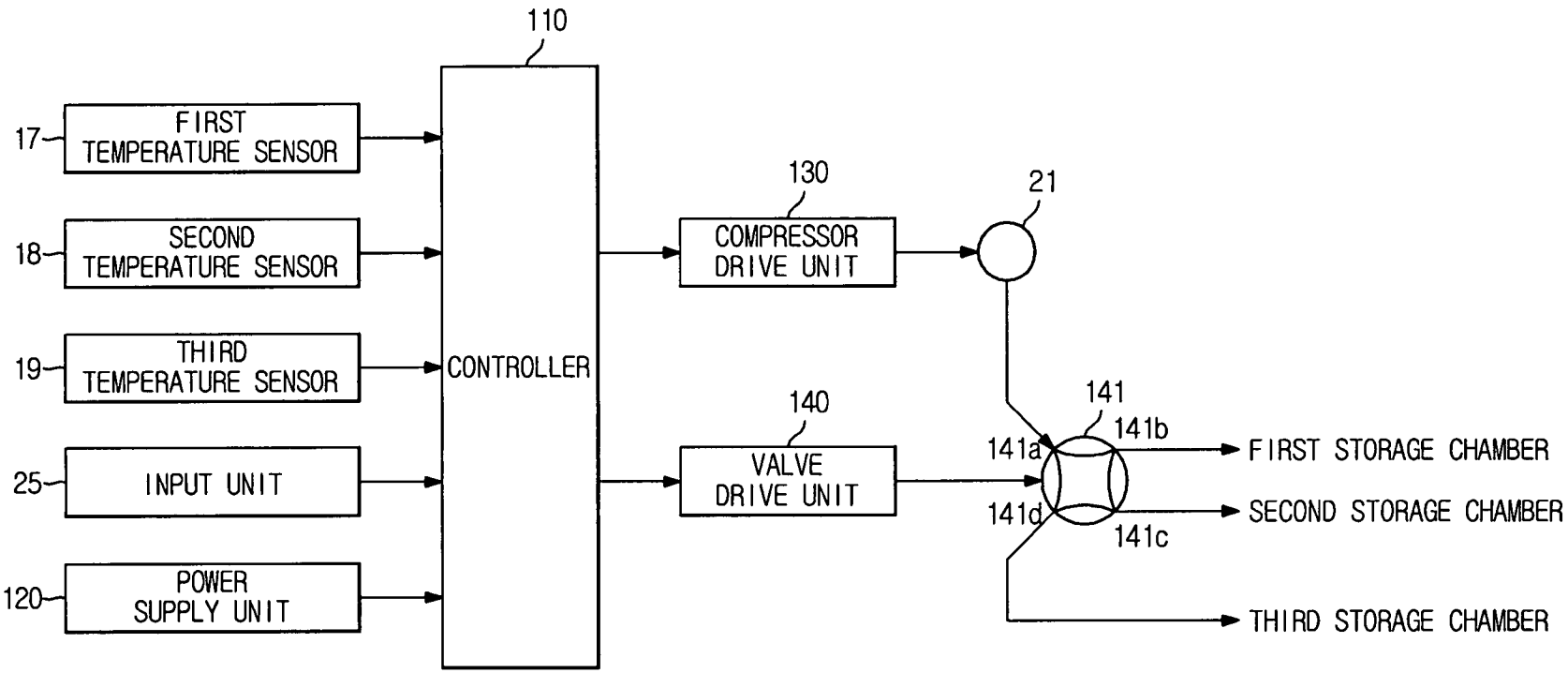
FIG. 5 is a schematic control block diagram of the refrigerator according to the embodiment.

FIG. 5 is a schematic control block diagram of the refrigerator according to the embodiment of the present invention.

As shown in FIG. 5, the first to third temperature sensors 17, 18 and 19 are electrically connected to the input side of a controller 110 to perform overall control of the refrigerator. The first to third temperature sensors 17, 18 and 19 detect temperatures of the first to third evaporator 14, 15 and 16 to sense temperatures of the first to third storage chambers 12*a*, 12*b* and 13, respectively. The first to third temperature sensors 17, 18 and 19 generate and provide electric signals corresponding to the detected temperatures to the controller 110.

Also, the input unit 25 to set and input temperatures of the first to third storage chambers 12*a*, 12*b* and 13 to the controller 110 and a power supply unit 120 to supply power are electrically connected to the input side of the controller 110.

A compressor drive unit 130 to drive the compressor 21 and a valve drive unit 140 to drive a refrigerant valve, i.e., a four-way valve 141, are electrically connected to the output side of the controller 110.

The controller 110 controls the compressor 21 and the four-way valve 141 such that temperatures of the first to third storage chambers 12*a*, 12*b* and 13 follow target temperatures based on temperature information detected by the first to third temperature sensors 17, 18 and 19.

The four-way valve 141 may be a stepper motor valve driven by a stepper motor. The four-way valve 141 includes one inlet port 141*a* and three outlet ports 141*b*, 141*c* and 141*d*. The first to third outlet ports 141*b*, 141*c* and 141*d* are alternately opened at predetermined rotation angles at which the respective outlet ports are opened such that a refrigerant is supplied to the storage chambers 12*a*, 12*b* and 13. When one of the outlet ports 141*b*, 141*c* and 141*d* is opened, the remaining two outlet ports are closed.

Figure 6:
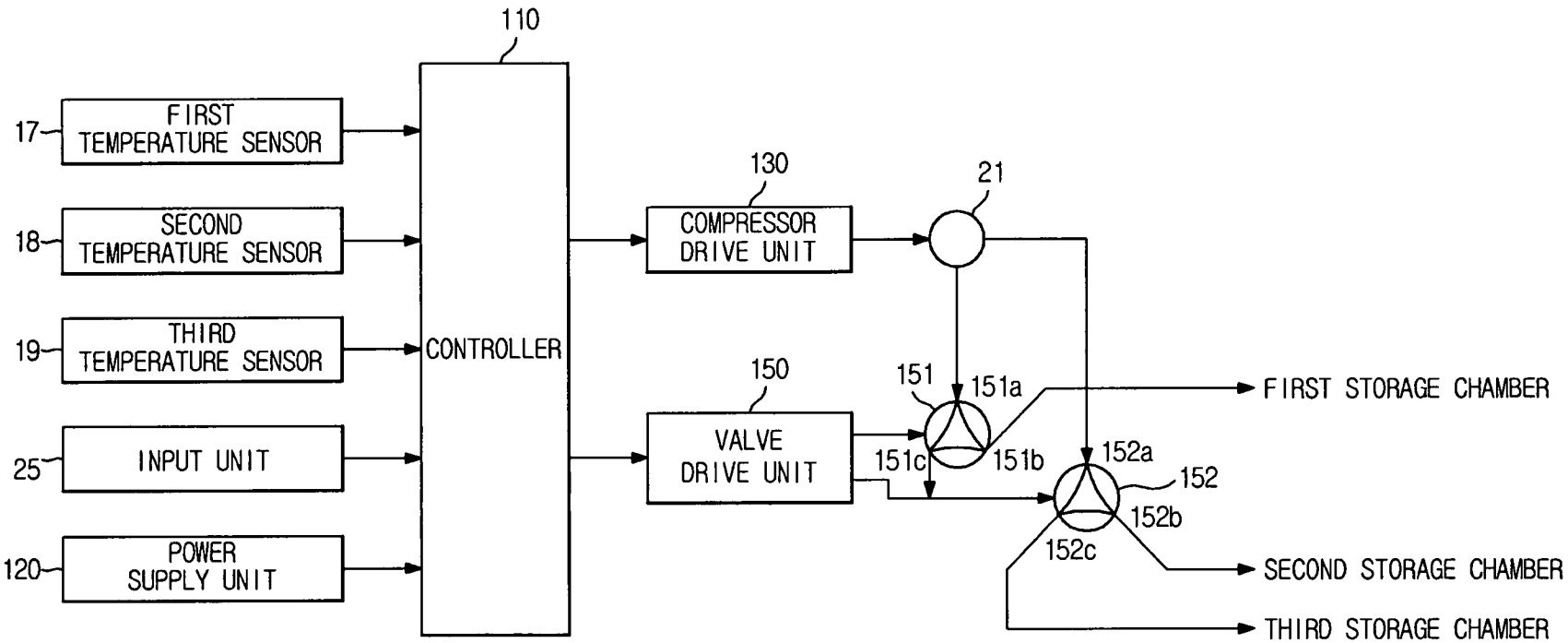
FIG. 6 is a view illustrating a refrigerant valve constituted by two three-way valves instead of one four-way valve in the refrigerator of FIG. 5.

As shown in FIG. 6, two three-way valves 151 and 152 may be used in place of the four-way valve 141. The three-way valve 151 includes one inlet port 151*a* and two outlet ports 151*b* and 151*c*. Also, the three-way valve 152 includes one inlet port 152*a* and two outlet ports 152*b* and 152*c*. The first and second outlet ports 151*b*, 151*c*, 152*b* and 152*c* are alternately opened at predetermined rotation angles at which the respective outlet ports are opened such that a refrigerant is supplied to the storage chambers 12*a*, 12*b* and 13. That is, a refrigerant compressed by the compressor 21 is introduced through the inlet ports 151*a* and 152*b* and is then supplied to the first to third storage chambers 12*a*, 12*b* and 13 through the outlet ports 151*b*, 151*c*, 152*b* and 152*c*. At this time, three of the outlet ports 151*b*, 151*c*, 152*b* and 152*c* are alternately opened to control a flow rate of the refrigerant to be supplied to the storage chambers 12*a*, 12*b* and 13.

When the refrigerant is supplied to at least two of the storage chambers 12*a*, 12*b* and 13, the controller controls only one of the outlet ports of each refrigerant valve to be alternately opened such that the refrigerant is supplied to the storage chambers.

The controller controls opening time of the refrigerant valve according to modes of the storage chambers to which the refrigerant is supplied. That is, the controller controls a rate of the refrigerant to be distributed into the respective storage chambers to which the refrigerant is supplied according to modes of the storage chambers to which the refrigerant is supplied. The controller controls the amount of the refrigerant to be supplied to the respective storage chambers to which the refrigerant is supplied based on a time rate corresponding to predetermined temperatures of the storage chambers to which the refrigerant is supplied.

Figure 8:
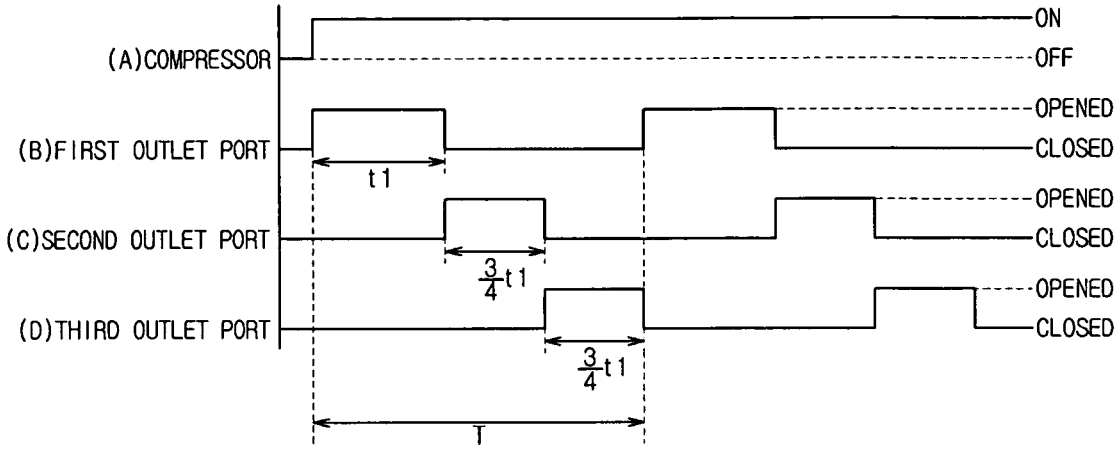
FIG. 8 is a view illustrating the operation of the four-way valve when all the storage chambers are operated as kimchi chambers in FIG. 7.
Figure 9:
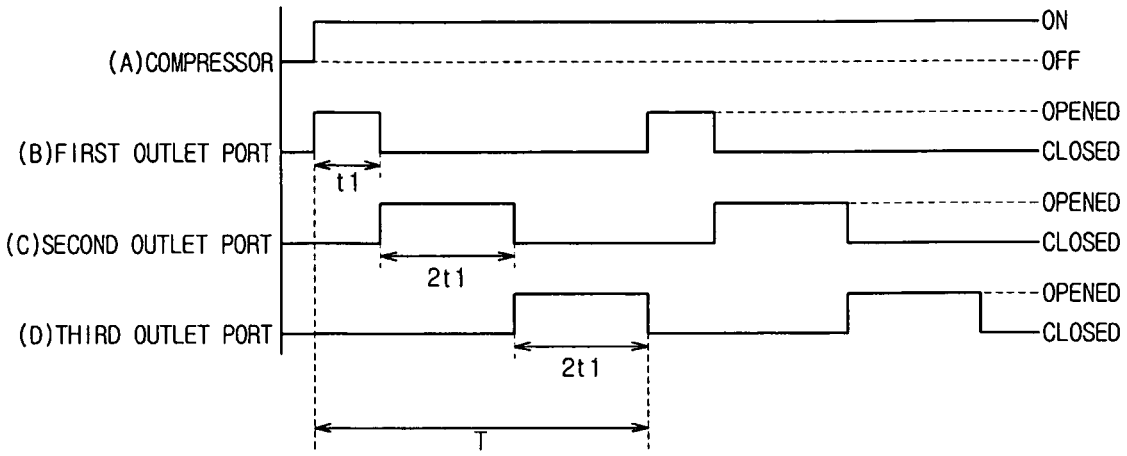
FIG. 9 is a view illustrating the operation of the four-way valve when the first storage chamber is operated as a freezing chamber, and the second and third storage chambers are operated as kimchi chambers in FIG. 7.
Figure 10:
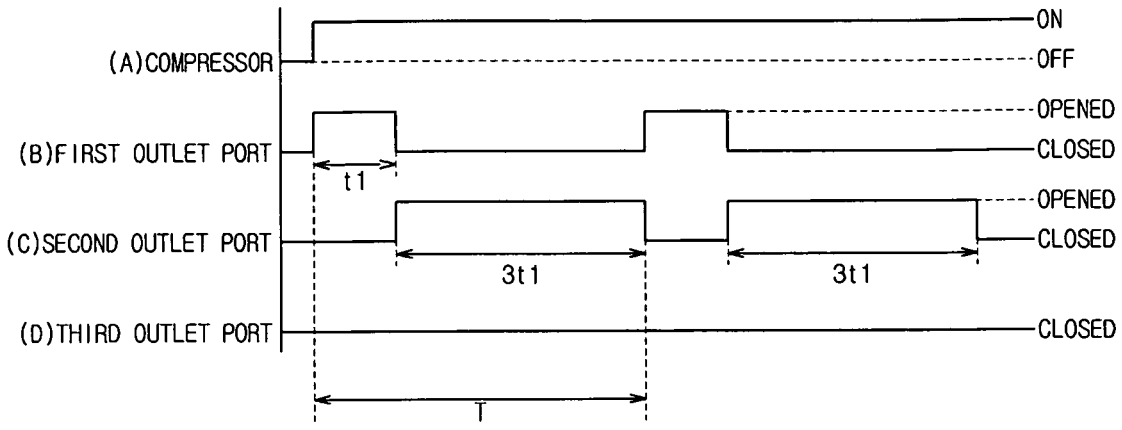
FIG. 10 is a view illustrating the operation of the four-way valve when the third storage chamber is not used in FIG. 9.

FIG. 7 is a view illustrating opening time and opening time rate of the refrigerant valve according to modes of the storage chambers in the refrigerator according to the embodiment. FIG. 8 is a view illustrating the operation of the four-way valve when all the storage chambers are operated as kimchi chambers in FIG. 7. FIG. 9 is a view illustrating the operation of the four-way valve when the first storage chamber is operated as a freezing chamber, and the second and third storage chambers are operated as kimchi chambers in FIG. 7. FIG. 10 is a view illustrating the operation of the four-way valve when the third storage chamber is not used in FIG. 9.

As shown in FIG. 7; opening time and opening time rate of the four-way valve 141 are preset based on modes of the first to third storage chambers 12*a*, 12*b* and 13.

As previously described, the four-way valve 141 alternately opens the first to third outlet ports 141*b*, 141*c* and 141*d* to supply the refrigerant to the storage chambers 12*a*, 12*b* and 13. When one of the outlet ports 141*b*, 141*c* and 141*d* of the four-way valve 141 is opened, the remaining two outlet ports are closed.

For example, when the first to third storage chambers 12*a*, 12*b* and 13 are operated as Kimchi chambers, an opening time rate of the first to third outlet ports 141*b*, 141*c* and 141*d* of the four-way valve 141 is preset to 4:3:3. On the assumption that a period T at which the first to third outlet ports 141*b*, 141*c* and 141*d* are controlled is 100 seconds, the first to third outlet ports 141*b*, 141*c* and 141*d* are alternately opened for 40 seconds, 30 seconds and 30 seconds, respectively (see FIG. 8).

Also, when the first storage chamber 12*a* is operated as a freezing chamber, and the second and third storage chambers

12*b* and 12*c* are operated as Kimchi chambers, an opening time rate of the first to third outlet ports 141*b*, 141*c* and 141*d* of the four-way valve 141 is preset to 2:4:4. On the assumption that a period T at which the first to third outlet ports 141*b*, 141*c* and 141*d* are controlled is 150 seconds, the first to third outlet ports 141*b*, 141*c* and 141*d* are alternately opened for 30 seconds, 60 seconds and 60 seconds, respectively (see FIG. 9). In this case, the opening time rate of the first to third outlet ports 141*b*, 141*c* and 141*d* of the four-way valve 141 is changed from 4:3:3 to 2:4:4. That is, an opening time rate of the outlet port corresponding to the freezing chamber is decreased, and the opening time rate of the outlet ports corresponding to the Kimchi chambers is increased correspondingly. Relatively low pressure is generated in the freezing chamber, with the result that a relatively large amount of the refrigerant is introduced into the freezing chamber due to concentration of the refrigerant although the outlet port is opened for a short time.

Also, when the first storage chamber 12*a* is operated as a freezing chamber, the second storage chamber 12*b* is operated as a Kimchi chamber, and the third storage chamber 12*c* is not used, an opening time rate of the first and second outlet ports 141*b* and 141*c* of the four-way valve 141 is preset to 1:3. The opening time rates of the refrigerant valve based on the modes of the storage chambers are stored in a memory. On the assumption that a period T at which the first and second outlet ports 141*b* and 141*c* are controlled is 120 seconds, the first and second outlet ports 141*b* and 141*c* are alternately opened for 30 seconds and 90 seconds, respectively (see FIG. 10).

For example, when a user changes the mode of the first storage chamber to a freezing chamber while all the three storage chambers are operated as Kimchi chambers, the opening time rate of the four-way valve is changed from 4:3:3 to 2:4:4. Consequently, concentration of the refrigerant to the freezing chamber is avoided, thereby preventing refrigerant shortage in the other storage chambers. Also, left and right temperature deviation of each storage chamber is reduced, thereby achieving uniform temperature distribution of each storage chamber.

Meanwhile, even the storage chambers having the same mode are affected by refrigeration concentration depending upon temperatures of the storage chambers. When the temperatures of the storage chambers are low, therefore, weight is applied to the storage chambers such that opening time rates of the outlet ports corresponding to the storage chambers are reduced.

As is apparent from the above description, the opening time rate of the refrigerant valve is changed based on the modes of the storage chambers to avoid concentration of the refrigerant, thereby preventing refrigerant shortage. Also, left and right temperature deviation of each storage chamber is reduced, thereby achieving uniform temperature distribution of each storage chamber.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a plurality of storage chambers operable in a cooling mode and a freezing mode;

a plurality of evaporators to refrigerate the storage chambers;

a valve having a plurality of outlet ports to supply a refrigerant to the evaporators; and a controller to control the valve such that only one of the outlet ports is opened when the refrigerant is supplied to the evaporators, wherein the controller controls opening time rate of the plurality of outlet ports based on modes of the plurality of storage chambers, the opening time rate of an outlet port corresponding to at least one storage chamber operated in the freezing mode is lower than the opening time rate of an outlet port corresponding to at least one storage chamber operated in the cooling mode.

2. The refrigerator according to claim 1, wherein the controller controls at least two of the outlet ports to be alternately opened and closed to supply the refrigerant to at least two of the evaporators such that the refrigerant is alternately supplied to the evaporators.

3. The refrigerator according to claim 2, wherein the controller controls the at least two of the outlet ports to be opened based on the time rate corresponding to the predetermined temperatures of the storage chambers to which the refrigerant is supplied when controlling the at least two of the outlet ports to be alternately opened and closed.

4. The refrigerator according to claim 3, wherein the time rate corresponding to the predetermined temperatures of the storage chambers is preset such that an opening time rate of the outlet ports corresponding to the storage chambers is low when predetermined temperatures of the storage chambers are low.

5. A control method of a refrigerator comprising a plurality of storage chambers operable in a cooling mode and a freezing mode, a plurality of evaporators to refrigerate the storage chambers, and a valve having a plurality of outlet ports to supply a refrigerant to the evaporators, comprising:

controlling the valve such that only one of the outlet ports is opened when the refrigerant is supplied to the evaporators, wherein the controlling the valve comprising determining modes of the plurality of storage chambers to which the refrigerant is supplied and controlling opening time rate of the plurality of outlet ports based on the determined mode of the plurality of storage chambers, and the opening time rate of an outlet port corresponding to at least one storage chamber operated in the freezing mode is lower than the opening time rate of an outlet port corresponding to at least one storage chamber operated in the cooling mode.

6. The control method according to claim 5, further comprising controlling at least two of the outlet ports to be alternately opened and closed to supply the refrigerant to at least two of the evaporators such that the refrigerant is alternately supplied to the evaporators.

7. The control method according to claim 6, wherein controlling the at least two of the outlet ports to be alternately opened and closed comprises controlling the at least two of the outlet ports to be opened based on the time rate corresponding to the predetermined temperatures of the storage chambers to which the refrigerant is supplied.

8. The control method according to claim 7, wherein the time rate corresponding to the predetermined temperatures of the storage chambers is preset such that an opening time rate of the outlet ports corresponding to the storage chambers is low when predetermined temperatures of the storage chambers are low.

9. A refrigerator comprising:

first, second and third storage chambers operable in a kimchi mode and a freezing mode;

first, second and third evaporators to refrigerate the first, second and third storage chambers;

a valve having at least three outlet ports to supply a refrigerant to the first, second and third evaporators; and a controller to control the valve such that only one of the outlet ports is opened when the refrigerant is supplied to the first, second and third evaporators, wherein the controller controls opening time of the valve based on modes of the first, second and third storage chambers to which the refrigerant is supplied, an opening time rate of an outlet port corresponding to at least one storage chamber operated in the freezing mode is lower than an opening time rate of an outlet port corresponding to at least one storage chamber operated in the kimchi mode.

10. The refrigerator according to claim 9, wherein the kimchi mode has a temperature of approximately −1° C. and the freezing mode has a temperature of approximately −18° C.

11. The refrigerator according to claim 10, wherein the controller controls at least two of the outlet ports to be alternately opened and closed to supply the refrigerant to at least two of the first, second and third evaporators such that the refrigerant is alternately supplied to the first, second and third evaporators.

12. The refrigerator according to claim 11, wherein the controller controls the at least two of the outlet ports to be opened based on the time rate corresponding to the predetermined temperatures of the first, second and third storage chambers to which the refrigerant is supplied when controlling the at least two of the outlet ports to be alternately opened and closed.

13. The refrigerator according to claim 12, wherein the time rate corresponding to the predetermined temperatures of the storage chambers is preset such that an opening time rate of the outlet ports corresponding to the first, second and third storage chambers is low when predetermined temperatures of the first, second and third storage chambers are low.

14. The refrigerator according to claim 9, wherein the valve is a four-way valve, the four-way valve being a stepper motor valve driven by a stepper motor, the four-way valve including one inlet port and three outlet ports.

15. The refrigerator according to claim 9, wherein the valve includes two three-way valves, each of the three-way valves including one inlet port and two outlet ports.

* * * * *